US008887638B1

(12) United States Patent
Calvert

(10) Patent No.: US 8,887,638 B1
(45) Date of Patent: Nov. 18, 2014

(54) GUN DISABLING EXPLODING BULLET

(71) Applicant: GDEB Associates, Trustee for Gun Disabling Exploding Bullet CRT Trust, Manassas, VA (US)

(72) Inventor: S. Mill Calvert, Manassas, VA (US)

(73) Assignee: GDEB Associates, Trustee for Gun Disabling Exploding Bullet CRT Trust, Manassas, VA (US)

( * ) Notice: Subject to any disclaimer, the term of this patent is extended or adjusted under 35 U.S.C. 154(b) by 0 days.

(21) Appl. No.: 14/158,530

(22) Filed: Jan. 17, 2014

(51) Int. Cl.
*F42B 5/00* (2006.01)
*F42B 99/00* (2006.01)
*F42B 12/20* (2006.01)

(52) U.S. Cl.
CPC ..... *F42B 12/20* (2013.01)
USPC ..... 102/430

(58) Field of Classification Search
CPC ..... F42B 12/20
USPC ..... 102/470, 501, 502, 509, 363, 431, 430, 102/293, 335, 346, 322
See application file for complete search history.

(56) References Cited

U.S. PATENT DOCUMENTS

| | | | |
|---|---|---|---|
| 36,686 | A | 10/1862 | Callender |
| 2,359,301 | A | 10/1944 | Church et al. |
| 2,363,024 | A | 11/1944 | Thibodeau |
| 2,472,118 | A | 6/1949 | Moore et al. |
| 4,216,722 | A | 8/1980 | Angell |
| 7,055,434 | B1 | 6/2006 | Thompson et al. |

OTHER PUBLICATIONS

Sage Control Ordinance Inc., Model BP45, 40MM Baricade Penetrating Projectile, specifications, published online at http: // www.sageinternationalltd.com/SCOI/specs/SCOI_SpecSheet_BP45.pdf, downloaded Oct. 10, 2013.

*Primary Examiner* — Reginald Tillman, Jr.
(74) *Attorney, Agent, or Firm* — Louis Ventre, Jr.

(57) ABSTRACT

A capsule is configured to have the outward appearance of a cartridge for a firearm and the capsule is designed to explode within a chamber of a firearm and disable the firearm when fired from the firearm. The capsule includes a casing; a bullet shaped container; a high explosive and a primer. The casing is made to fit within a firing chamber of the firearm. A bullet-shaped container holds a high explosive and fits within the casing to give an outward appearance of an ordinary bullet in a regular cartridge for that firearm. The primer is accessible to a firing pin of the firearm acting on the casing. The primer includes a small charge of a mixture in contact with the high explosive such that when the primer is struck by the firing pin of the firearm, the primer causes the high explosive to detonate disabling the firearm.

2 Claims, 1 Drawing Sheet

GUN DISABLING EXPLODING BULLET

TECHNICAL FIELD

In the field of ammunition and explosives, an exploding bullet disguised as a cartridge which upon firing disables a weapon.

BACKGROUND ART

Throughout the long history of war and military conflict, there have been various techniques and strategies that have been developed and practiced. These strategies are taught at West Point, The Naval Academy in Annapolis, and our other military academies and schools. One of these ancient military strategies is to try and sabotage the enemy's equipment. In today's high-tech environment, much of this sabotage effort is focused on the digital computer chip and installing programs and viruses that can later be activated. The problem with this narrow focus, mostly on high-tech sabotage, is that the enemy's largest and most important equipment of war has been overlooked. The enemy's most important equipment is, of course, its ammunition. Without a supply of dependable ammunition, a military force is of no use unless they are going to use their riffle as a club to hit somebody.

SUMMARY OF INVENTION

A capsule is configured to have the outward appearance of a cartridge for a firearm and the capsule is designed to explode within a chamber of a portable firearm and disable the firearm when fired from the firearm. The capsule includes a casing; a bullet shaped container; a high explosive and a primer. The casing made to fit within a firing chamber of the firearm. A bullet-shaped container holds a high explosive and fits within the casing, defining an inner container volume preferably extending from the inside wall of the firing end of the casing to a point beyond the end of the casing, to give an outward appearance of an ordinary bullet in a regular cartridge for that firearm. The bullet-shaped container when inserted into the casing closes off the open end of the casing just like in a regular cartridge. A primer is accessible to a firing pin of the firearm acting on the casing as it would in a regular cartridge. The primer includes a small charge of a mixture in contact with the high explosive such that when the primer is struck by the firing pin of the firearm, the primer causes the high explosive to detonate disabling the firearm.

Technical Problem

The majority of the enemy we face today, use AK-47's and ammunition to kill our soldiers and even shoot down our hi-tech helicopters. An important military strategy in the War on Terror would be to find an easy way to sabotage the enemy ammunition.

Solution to Problem

The solution is a gun disabling exploding bullet is a hollow metal capsule that is inserted into a standard brass casing that has a standard primer. The gun disabling exploding bullet fills a contained space inside the casing and the part that sticks out the top of the casing looks like any other regular bullet. The inside of the gun disabling exploding bullet includes a high explosive, which are well known in the field. The bottom of the gun disabling exploding bullet preferably has a strike point to ignite the primer, which then ignites the high explosive. If you hold a regular round in one hand and a gun disabling exploding bullet round in the other hand, they should be identical in appearance and heft so that the user cannot tell them apart. The gun disabling exploding bullet is preferably manufactured with a marking system that the enemy will not recognize, so later, in peace time, the gun disabling exploding bullet ammunition can be separated out so it would not cause an unwanted accident. Examples of such a marking system are an RFID chip, a magnetic marker, a chemical coating, or many other types of marking systems.

Advantageous Effects of Invention

The gun disabling exploding bullet that looks identical to any other ammunition the enemy may have. When an enemy soldier fires a gun disabling exploding bullet round from his gun, the gun will explode in his face and kill him and probably injure one or two other enemy soldiers that may be next to him. As fellow enemy soldiers see their friends being blown apart, they will all be hesitant to try to fire their weapons anymore, because the next round they chamber may kill them if they squeeze the trigger. This would be like trying to convince a soldier to try and fight a war by playing Russian roulette. Troop morale would drop to about zero as most fighters remove all cartridges from their weapons and retreat. Word would spread throughout the entire enemy army and nobody would have any confidence in any of the ammunition. This lack of dependable ammunition could bring a quick end to the war or conflict.

The primary component of war is an enemy's ammunition. Without dependable ammunition, the enemy has nothing to fight with. The gun disabling exploding bullet will now add another very useful military tool that will help to shorten conflicts, save our soldiers' lives, and help to win the War on Terror.

BRIEF DESCRIPTION OF DRAWINGS

The drawings illustrate preferred embodiments of the gun disabling exploding bullet according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate a preferred embodiment of the gun disabling exploding bullet according to the disclosure herein. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 2:
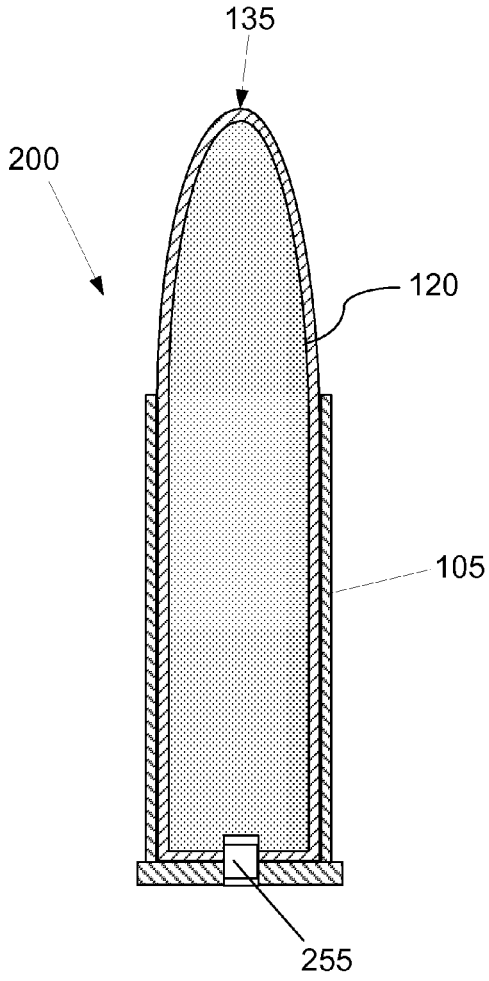
FIG. 2 is a sectional elevation view of the gun disabling exploding bullet shown in FIG. 1.

A capsule (200), shown in FIG. 2, is configured to have the outward appearance of a cartridge for a firearm. The capsule (200) may be configured to mimic the appearance of any particular cartridge. For example, the capsule (200) preferably looks like an ordinary cartridge usable in a pistol or in a rifle. Examples of some common cartridges are 0.17 caliber HM2; 0.17 caliber HMR; 0.22 caliber LR 4; 0.22 caliber WMR; 0.17/23 caliber SMc; 5 mm/35 caliber SMc 7; 0.22 caliber HORNET; 0.223 caliber REMINGTON; 0.223 caliber WSSM; 0.243 caliber WINCHESTER; 0.243 caliber WINCHESTER Improved (Ackley); 0.25-06 caliber REMINGTON; 0.270 caliber WINCHESTER; 0.308 caliber WINCHESTER; 0.30-06 caliber SPRINGFIELD; 0.45-70 caliber Government; and 0.50-90 caliber SHARPS.

A cartridge is also commonly referred to as a round or a shell and may have varied shapes, sizes and outward appearances for a particular firearm and a particular shooting purpose. The capsule (200) would therefore preferably also take on the same shape, size, weight and outward appearance of the cartridge it is intended to mimic. Thus the capsule (200) would mirror the neck size, overall cartridge weight and caliber, headspace, overall length, case body diameter and taper, shoulder design, rim type, etc, but obviously would have a different maximum operating pressure because it is intended to destroy the gun from which it is fired.

A cartridge is a type of ammunition typically packaging together a bullet, a propellant substance, which is usually either smokeless powder or black powder, and a primer. The capsule (200) is different in that it does not contain a propellant substance because propelling the bullet from the chamber of the gun is not the function of the capsule. Rather, the function of the capsule (200) is to explode within the chamber of the firearm, thereby destructively disabling the firearm.

In most regular ammunition, the cartridge primer is a small charge of an impact-sensitive or electric-sensitive chemical mixture that can be located at the center of the case head (centerfire ammunition), inside a rim (rimfire ammunition), or in a projection such as in a pinfire or teat-fire cartridge. The primer (255) of the capsule (200) is a similar device, but is different in that it operates on the high explosive (150) instead of the propellant substance in a regular cartridge.

The capsule (200) is adapted to, that is, the capsule is designed to, explode within the chamber of a firearm and destructively disable the firearm when impacted by the firing pin of a firearm. The firearm is any portable gun having a barrel that launches one or more projectiles when a firing pin in the firearm impacts a cartridge loaded in the chamber.

Figure 1:
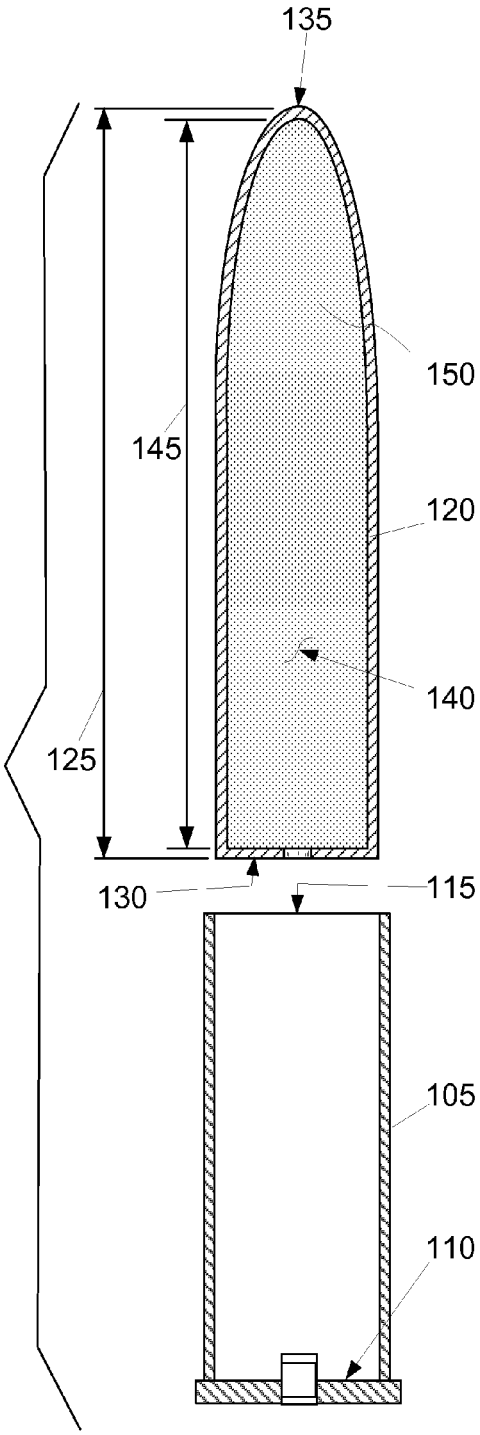
FIG. 1 is an exploded sectional elevation view of the gun disabling exploding bullet.

FIG. 1 is an exploded sectional elevation view showing the components of a preferred embodiment of the capsule (200). The capsule (200) includes a casing (105); a bullet shaped container (120); a high explosive (150) and a primer (255). FIG. 2 shows these components in assembled form.

The casing (105) is made to fit within a firing chamber of a portable firearm, the casing (105) having a closed end (110) and an open end (115). The casing (105) is designed to mimic, that is be identical in outward appearance, to an operable cartridge case. In that sense, the casing (105) will also seal the weapon's firing chamber in all directions excepting the bore.

The bullet-shaped container (120) has an outer length (125) defined by a proximal end (130) and a distal end (135).

The proximal end (130) is the end of the bullet-shaped container (120) located nearest the closed end (110) of the casing (105). The proximal end (130) is made to fit tightly within the casing (105) below the open end (115) of the casing (105). A preferably embodiment is one where the bullet-shaped container (120) has a length sufficient to enable placing the proximal end (130) adjacent to the closed end (110) of the casing so that the bullet-shaped container (120) occupies the space defined by the casing (105). So for this preferably embodiment, the proximal end (130) of the bullet-shaped container (120) is located adjacent to the closed end (110) of the casing (105), as shown in FIG. 2.

The distal end (135) is the end of the bullet-shaped container (120) that extends past the open end (115) of the casing (105). The part of the bullet-shaped container (120) that extends above the open end (115) of the casing (105) terminating at the distal end (135) is the part of the capsule (200) that looks like the bullet in a regular or functional cartridge that can be fired from a weapon.

The bullet-shaped container (120) defines an internal volume (140). Thus, the internal volume (140) has an internal length (145) from the proximal end (130) to a point before the distal end (135). While the internal volume of the bullet-shaped container (120) need only be sufficient to hold a damaging charge of high explosive, that point is preferably located at a distance from the proximal end (130) that is past, that is above, the open end (115) of the casing (105) when the bullet-shaped container (120) is within the casing (105). Even more preferably, the point is near the distal end (135), so that the internal volume (140) occupies almost the entire outer dimensions of the bullet-shaped container (120), except a thin wall needed to preserve the appearance of a bullet. Such a configuration, shown in FIG. 2, limits the chance that detonation of the high explosive (150) would cause the top of the bullet-shaped container (120) to break off and be propelled from the chamber of the gun.

The bullet-shaped container (120) when inserted into the casing (105) closes off the open end (115) of the casing (105). This configuration is needed so that the capsule (200) looks like the cartridge it mimics.

The high explosive (150) is resident within the internal volume (140). Thus, the high explosive (150) is loaded into the bullet-shaped container (120). A sufficient charge of high explosive will be needed to permanently disable the weapon when it is fired. Since modern centerfire cartridges are often loaded to about 65,000 pounds per square inch (psi) (450,000 kPa) maximum chamber pressure, and since this is the highest pressure cartridge used of the available cartridges, then a charge of high explosive sufficient to create a pressure of about ten times that maximum chamber pressure, or 650,000 psi is preferable. There are numerous well known high explosives suitable for weapons use as described herein, such as a C-4 plastic explosive, RDX, polymer-bonded explosive, also called PBX, PE4, Composition B, Composition C, PENTOLITE, and SEMTEX.

The primer (255) includes a small charge of a mixture in contact with the high explosive (150) such that when the primer (255) is struck by a firing pin of the portable firearm, the primer (255) causes the high explosive (150) to detonate.

The capsule (200) is preferably manufactured with a hidden marking that the enemy will not easily recognize. This marking will permit identification of the capsule (200) so that friendly forces can readily separate out the capsule (200) so as not to cause an unwanted accident. Examples of such a hidden marking include an RFID chip, a magnetic marker, an ultraviolet marking, an infrared marking, a specific chemical coating, or such other marking as may be functional for this purpose.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the firearms industry.

What is claimed is:

1. A capsule configured to have an outward appearance of a cartridge for a firearm, the capsule adapted to explode within a chamber of a firearm and disable the firearm, the capsule comprising:

a casing made to fit within a firing chamber of a portable firearm, the casing having a closed end and an open end;

a bullet-shaped container having an outer length defined by a proximal end and a distal end, the proximal end made to fit tightly within the casing below the open end of the casing;

the distal end extending past the open end of the casing;

the bullet-shaped container defining an internal volume, the internal volume having an internal length from the proximal end to a point before the distal end, said point being past the open end of the casing when the bullet-shaped container is within the casing; and the bullet-shaped container when inserted into the casing closes off the open end of the casing;

a high explosive resident within the internal volume; and a primer comprising a small charge of a mixture in contact with the high explosive such that when the primer is struck by a firing pin of the portable firearm, the primer causes the high explosive to detonate.

2. The capsule of claim 1, wherein the proximal end of the bullet-shaped container is located adjacent to the closed end of the casing.

* * * * *